US007721571B2

(12) United States Patent
Rose et al.

(10) Patent No.: US 7,721,571 B2
(45) Date of Patent: May 25, 2010

(54) CLOTHING JEWELRY

(76) Inventors: Gary E. Rose, 2579 St. Lawrence Dr., San Jose, CA (US) 95124; Anna M. Rose, 2579 St. Lawrence Dr., San Jose, CA (US) 95124

( * ) Notice: Subject to any disclaimer, the term of this patent is extended or adjusted under 35 U.S.C. 154(b) by 804 days.

(21) Appl. No.: 11/584,634

(22) Filed: Oct. 23, 2006

(65) Prior Publication Data

US 2007/0089456 A1 Apr. 26, 2007

Related U.S. Application Data

(60) Provisional application No. 60/730,041, filed on Oct. 26, 2005.

(51) Int. Cl.
*A44C 25/00* (2006.01)

(52) U.S. Cl. ..... 63/33; 2/308; 63/3

(58) Field of Classification Search ..... None
See application file for complete search history.

(56) References Cited

U.S. PATENT DOCUMENTS

| | | | | |
|---|---|---|---|---|
| 570,940 | A | 11/1896 | Maynard | |
| 633,889 | A | 9/1899 | Nottingham | |
| 1,900,979 | A * | 3/1933 | De Ment | 24/299 |
| 2,097,677 | A | 11/1937 | Sokoloff | |
| 2,228,686 | A | 1/1941 | Bezault | |
| 2,245,463 | A | 6/1941 | Cohn | |
| 2,408,688 | A | 10/1946 | Schonthal | |
| D154,499 | S | 7/1949 | Levine | |
| D179,669 | S | 2/1957 | Williams | |
| 4,448,017 | A | 5/1984 | Stark | |
| D294,882 | S | 3/1988 | Harrell | |
| D298,581 | S | 11/1988 | Diaz | |
| 4,885,805 | A | 12/1989 | Mason | |
| 5,542,156 | A | 8/1996 | Oglesby | |
| D375,398 | S | 11/1996 | Cetrangelo | |
| D381,189 | S | 7/1997 | Geliebter | |
| 5,644,935 | A | 7/1997 | Jonovich et al. | |
| D385,089 | S | 10/1997 | Wright, Jr. | |
| 5,713,080 | A | 2/1998 | Tate | |

(Continued)

FOREIGN PATENT DOCUMENTS

WO WO 2004103108 12/2004

OTHER PUBLICATIONS http://www.overstock.com/cgi-bin/d2.cgi?cid=48419 &PAGE=PRODUCT&PROD_ID=1017300&fp=F "OTB Men's Denim Jeans with Chain" retrieved on Aug. 11, 2005.

*Primary Examiner*—Jack W. Lavinder
(74) *Attorney, Agent, or Firm*—Dale J. Ream

(57) ABSTRACT

The clothing jewelry is formed from a plurality of short chains removably attached to an article of clothing to form a plurality of vertically extending retainer loops, and an elongated decorative member supported by the retainer loops and encircling a portion of the clothing, e.g., a pant leg, a jacket or blouse adjacent the cuff, a skirt adjacent the hemline, and similar clothing articles. The elongated member may be a jewelry chain formed into a continuous or endless loop, a ribbon formed into an endless loop, or other decorative loops. The short chains have fasteners, e.g., a pin and back fastener, at both ends for removable attachment to the article of clothing.

17 Claims, 9 Drawing Sheets

U.S. PATENT DOCUMENTS

| | | | |
|---|---|---|---|
| 5,956,775 | A | 9/1999 | Ezra |
| 6,026,515 | A | 2/2000 | Nielson et al. |
| 6,070,434 | A | 6/2000 | Traver |
| 6,076,194 | A | 6/2000 | Purkett |
| 6,098,202 | A | 8/2000 | Peck |
| D490,215 | S | 5/2004 | Gonzales |
| D490,216 | S | 5/2004 | Powell |
| 2002/0042937 | A1 | 4/2002 | Green |
| 2005/0155138 | A1 | 7/2005 | Zic-Hock et al. |

* cited by examiner

CLOTHING JEWELRY

CROSS-REFERENCE TO RELATED APPLICATION

This application claims the benefit of U.S. Provisional Patent Application Ser. No. 60/730,041, filed Oct. 26, 2005.

BACKGROUND OF THE INVENTION

1. Field of the Invention

The present invention relates to accessories for clothing, and more particularly to clothing jewelry for the ornamentation and decoration of articles of clothing.

2. Description of the Related Art

Several jewelry items are available that can be attached to clothing, e.g., collar pins, brooches, cuff links, etc. However, little attention has been paid to the lower portion of garments. For example, the cuffs of blue jeans are often very plain. The decoration and ornamentation of the cuffs of pants, the hems of skirts, and the cuffs of blouses, blue jean jackets, and the like is usually limited to the decorative stitching of the hem, the attachment of feathers or puffs, the stitching of fabric emblems around the pant leg, sleeve or skirt, and the like.

Such ornaments are usually permanently attached to the garment. Removable decoration is usually limited to elastic bands that can be pulled over the pant leg or sleeve and that carry a decorative design. The result is that the appearance of clothing can usually only be modified by changing accessories worn with the clothing, such as belts, shoes, and the like. A decorative touch can be added by wearing an ankle bracelet, wrist bracelet, or other jewelry item, but the clothing itself is usually unadorned in the lower regions. W.I.P.O. Patent Number WO 2004/103108, published Dec. 2, 2004, discloses a piece of jewelry comprising an ornamental element such as a precious stone, however does not appear to disclose or suggest that the ornamental element can be worn in the manner as described in the present invention.

There is a need for a decoration or ornament for pant legs, for skirts near the hemline, for the sleeves of jackets, blouses and the like, and for similar items of clothing. It would also be desirable that the ornamentation be removable and replaceable so that the ornamentation can be coordinated to match belts, shoes, and other accessories worn with the clothing.

Thus, clothing jewelry solving the aforementioned problems is desired.

SUMMARY OF THE INVENTION

The clothing jewelry is formed from a plurality of short chains removably attached to an article of clothing to form a plurality of vertically extending retainer loops, and an elongated decorative member supported by the retainer loops and encircling a portion of the clothing, e.g., a pant leg, a jacket or blouse adjacent the cuff, a skirt adjacent the hemline, and similar clothing articles. The elongated member may be a jewelry chain formed into a continuous or endless loop, a ribbon formed into an endless loop, or other decorative loops. The short chains have fasteners, e.g., a pin and back fastener, at both ends for removable attachment to the article of clothing.

Since the clothing jewelry is removable, the jewelry may be coordinated with other clothing accessories, such as belts and shoes. The endless loop can be substituted with chains having links of different shapes or sizes, or a ribbon may be substituted for a chain. The retainer loops may be exchanged to substitute the style of link or the decorative pinhead. The clothing jewelry provides a unique and easy way to decorate an otherwise plain article of clothing.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
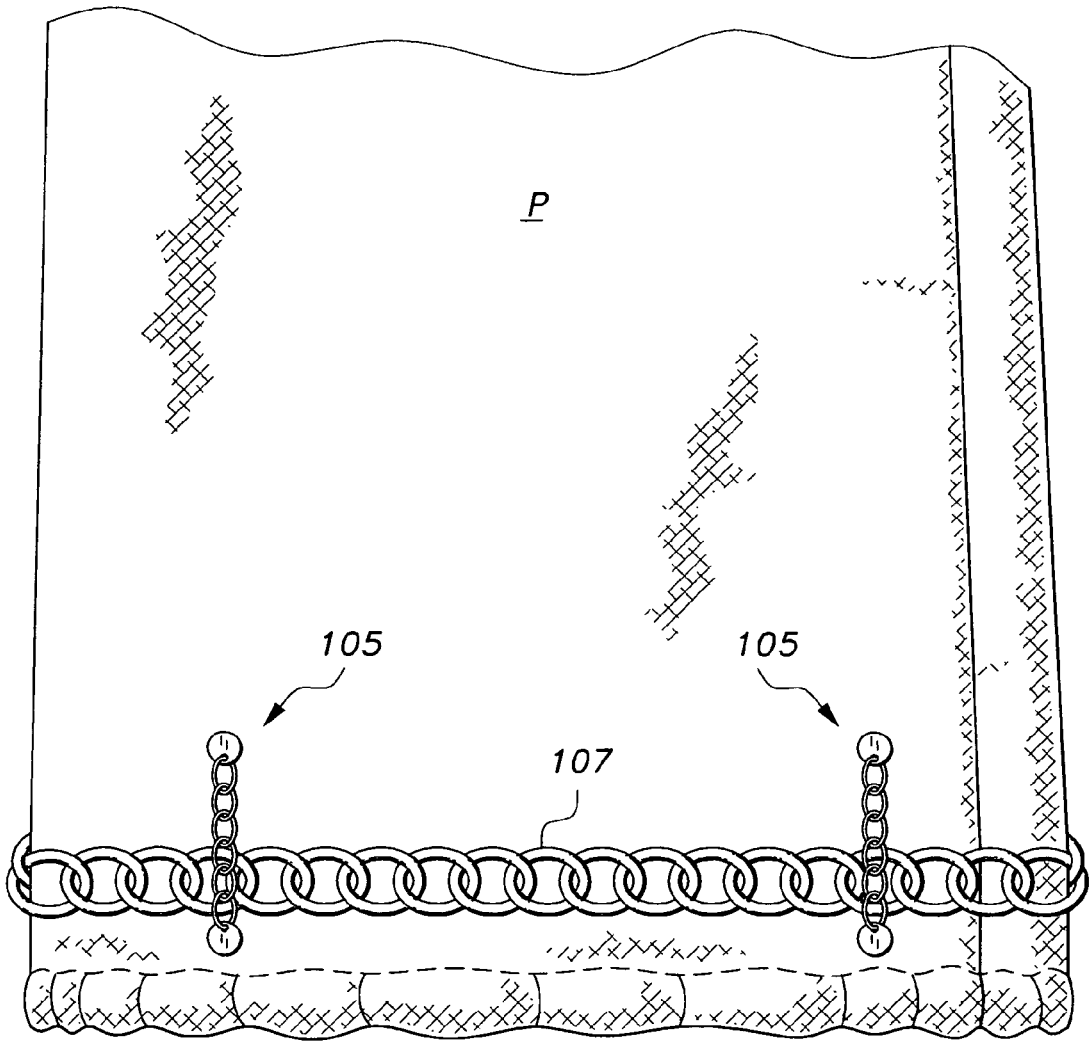
FIG. 1 is an environmental view of clothing jewelry according to the present invention.

The present invention is clothing jewelry for the ornamentation and decoration of articles of clothing, particularly pant legs and jacket or blouse sleeves adjacent the cuffs and skirts adjacent the hemline. The clothing jewelry includes a plurality of short chains that are removably fastened to the clothing to form retainer loops 105. The retainer loops 105 are disposed circumferentially around an item of clothing, such as a pant leg P, as shown in FIG. 1. The retainer loops 105 are capable of supporting and holding in place an adornment, i.e., an elongated decorative member 107 formed into a continuous or endless loop that is disposed circumferentially around an item of clothing such as pant leg P.

Figure 2:
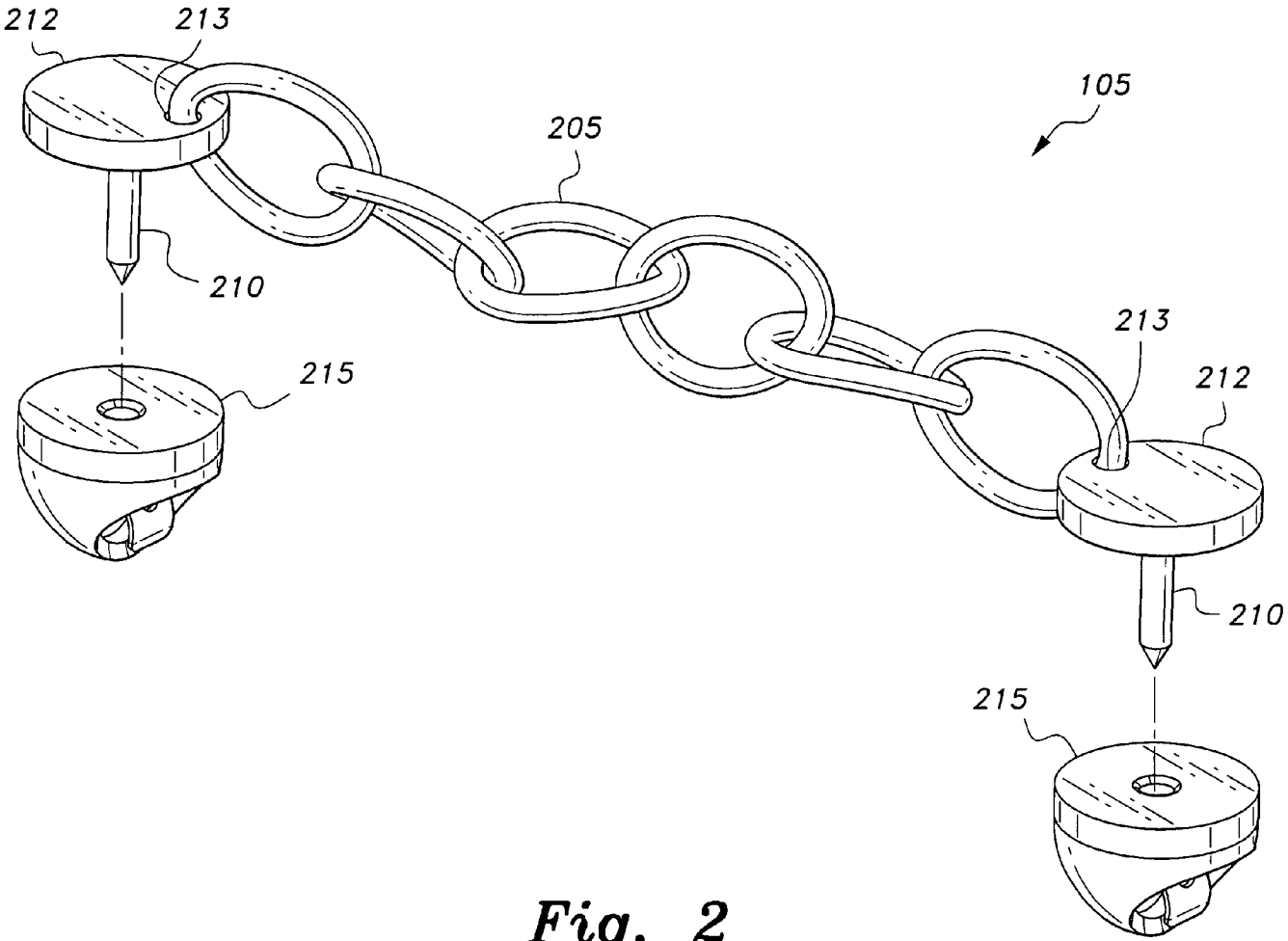
FIG. 2 is a perspective view of the short chain retainer loop components of the clothing jewelry according to the present invention.
Figure 3:
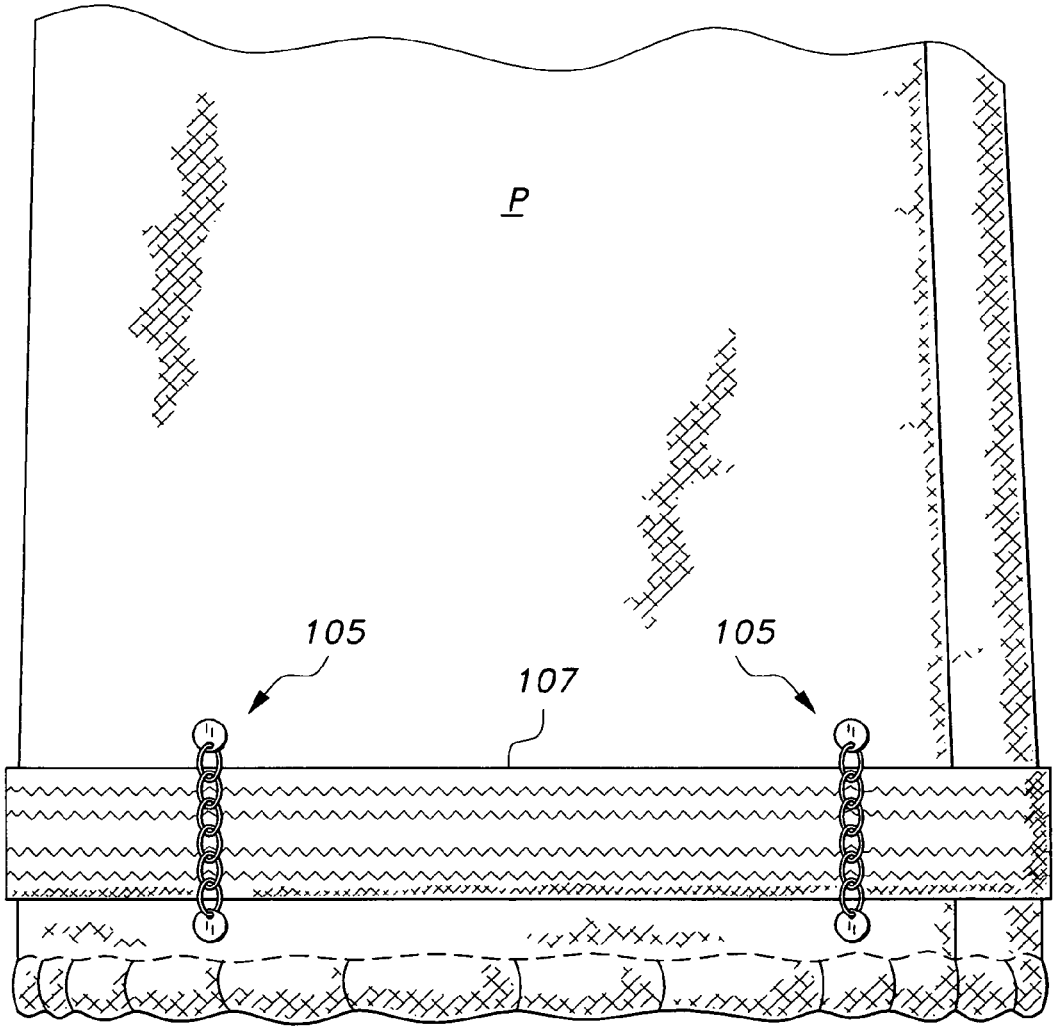
FIG. 3 is an environmental view of the clothing jewelry according to the present invention showing an alternative decorative endless loop member.

As shown in FIG. 2, each retainer loop 105 comprises a plurality of links 205 forming the chain. A pin 210 is attached to each end of the chain. Each pin 210 has a broad head 212, which may include a decorative element formed on or attached to the head 212. The pinhead 212 includes an eccentric hole 213 receiving the end link in the chain. The pins 210 are removably attached to an article of clothing, such as denim pant leg P, by piercing the article of clothing and attaching a back fastener, such as a clutch-back 215, to the end of the pin 210. As shown in FIG. 1, the retainer loops 105 are aligned vertically and disposed circumferentially around the pant leg P. The retainer loops 105 may be formed from links 205 of the same size and shape, or some loops 105 may have fine links and others coarse or large links, and retainer loops 105 may be interchanged or replaced to change the decorative pinhead ornamentation.

The retainer loop chain links 205 and pins 210 may be made of a variety of materials, including, but not limited to, plastic, aluminum, copper, titanium, steel, and the like. The color of the links 205 may be provided to match color of the clothing.

As shown in FIG. 1, the elongated decorative member 107 may be a chain formed into a continuous or endless loop. The endless loop may be permanently formed by soldering all of the links closed, or the decorative member 107 may have a clasp or other fastener for releasably forming the endless loop. The links may be fine or coarse. If desired, it may be possible to attach pendants or charms to the links of the endless loop decorative member 107, depending upon the weight of the pendant and the strength of the clothing material.

Alternatively, the elongated decorative member 107 may be a ribbon formed into a continuous or endless loop to encircle, the pant leg, sleeve, skirt, or other clothing member. The ribbon may be a cloth material, metallic or plastic strip, leather, and the like. The color(s) of the ribbon may be selected to match color of item of clothing. The ribbon may be formed into an endless loop by stitching the ends together, or may be provided with a releasable fastener, such as a buckle or hook and loop fasteners, at opposing ends of the ribbon.

Figure 4:
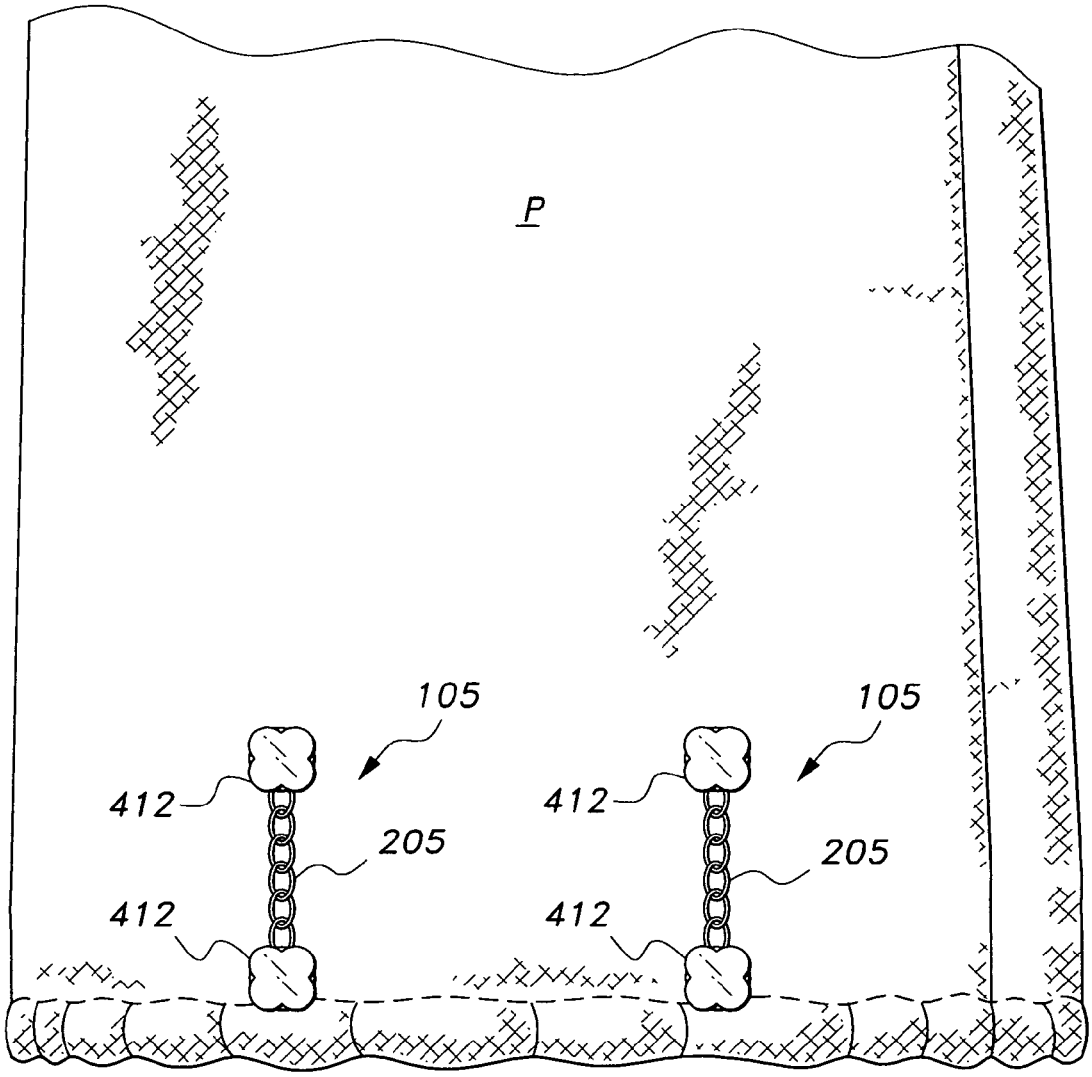
FIG. 4 is an environmental view of the clothing jewelry showing a rhinestone embodiment, according to the present invention.

As shown in FIG. 4, the present invention 105 may comprise rhinestone studded attachment pins 41 2 that advantageously adorn the vertical chain links 205 while providing attachment points of ends of the links 205 to an article of clothing such as pant leg P. A clutch-back such as clutch back 215 shown in FIG. 2 may be used to retain the pins 412 in place on the garment.

Figure 5:
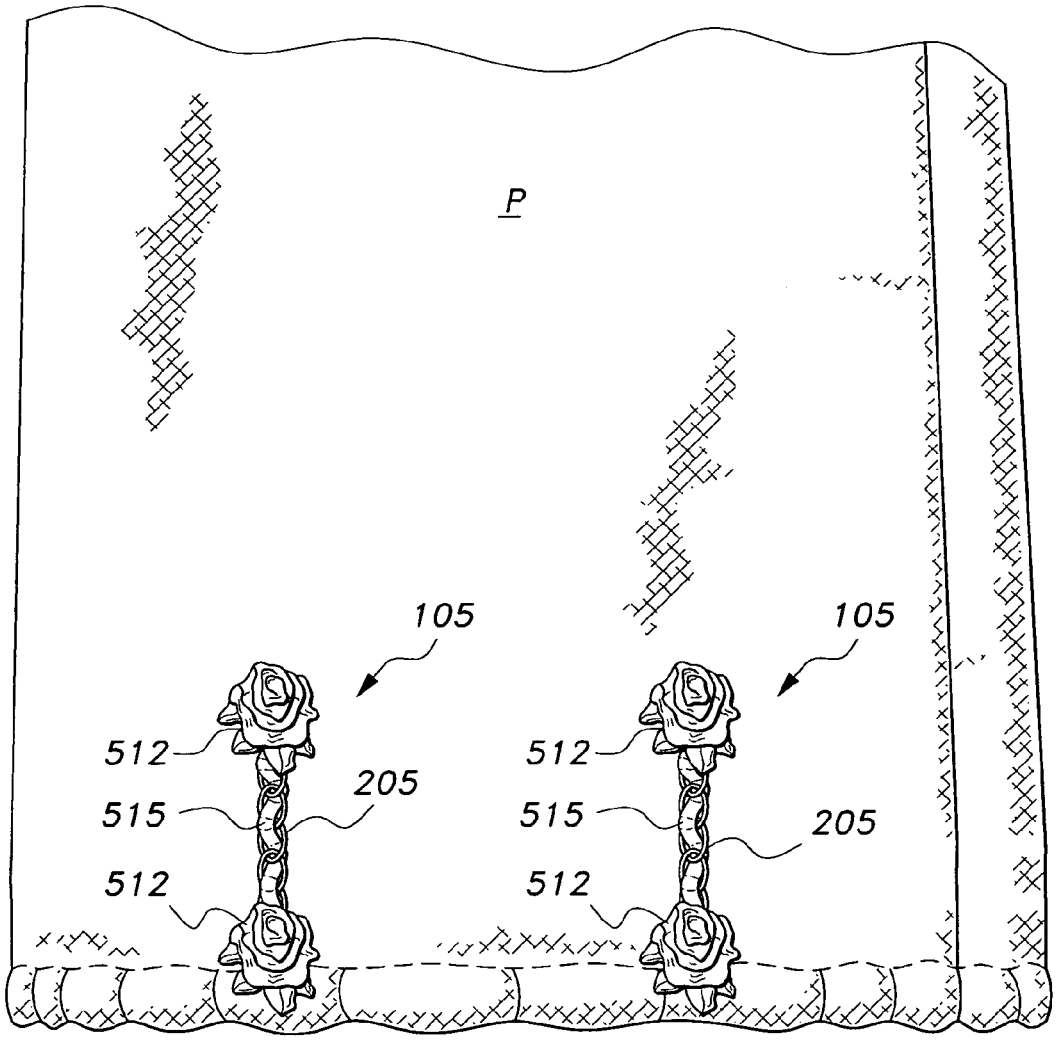
FIG. 5 is an environmental view of the clothing jewelry showing a floral embodiment, according to the present invention.

As shown in FIG. 5, the present invention 105 may comprise rose studded attachment pins 512 that advantageously adorn the vertical chain links 205 while providing attachment points of ends of the links 205 to an article of clothing such as pant leg P. Additionally, the chain links 205 may be threaded with a ribbon 515 that may provide additional structural support as well as additional aesthetic appeal. Additionally, a clutch-back such as clutch back 215 shown in FIG. 2 may be used to retain the pins 512 in place on the garment.

Figure 6:
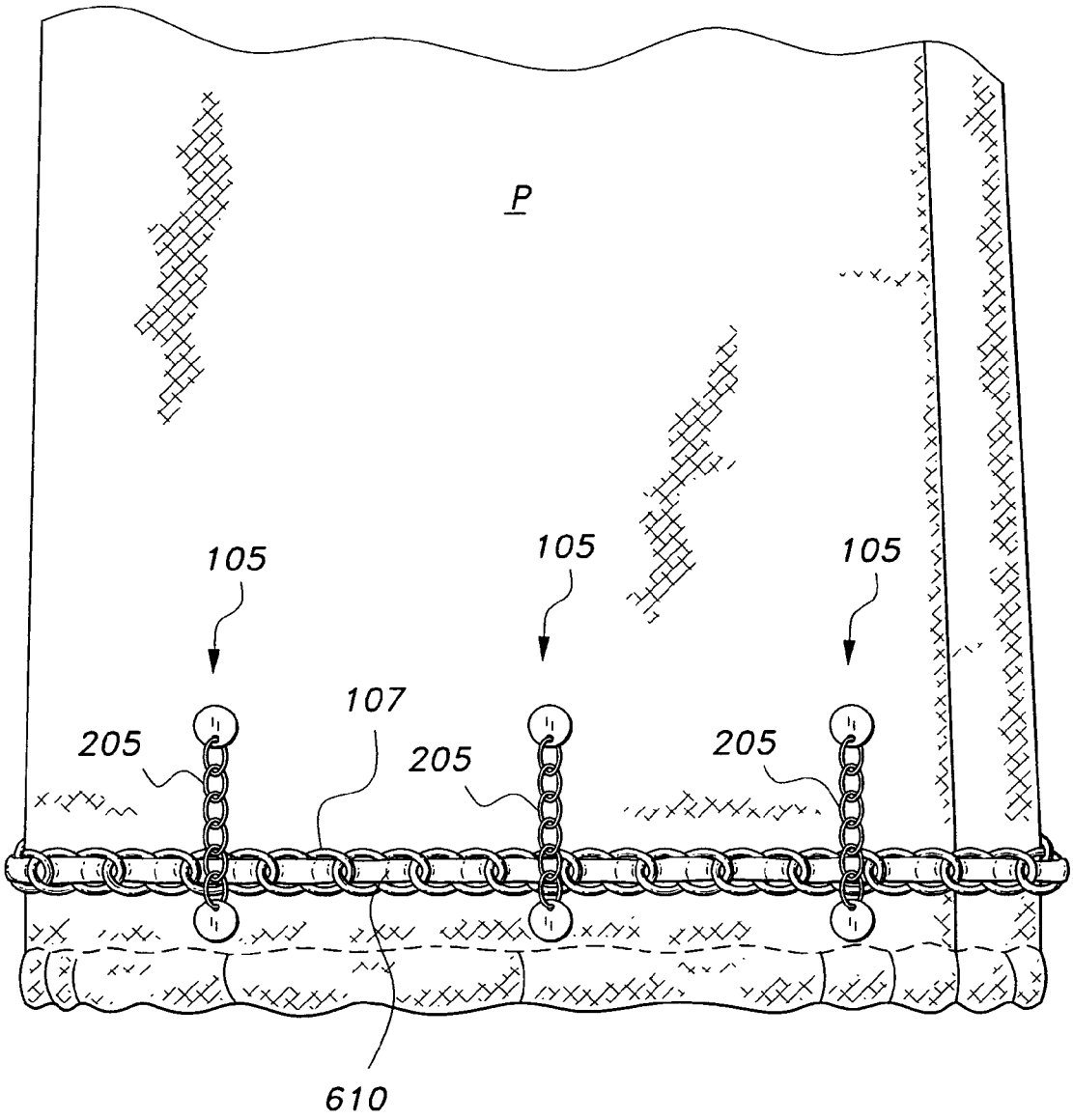
FIG. 6 is an environmental view of the clothing jewelry showing a ribbon through leg loops embodiment, according to the present invention.

As shown in FIG. 6, the present invention 105 may comprise a ribbon loop 610 that is threaded through the chain loop 107 to advantageously adorn the loop 107 as well as provide additional structural support.

Figure 7:
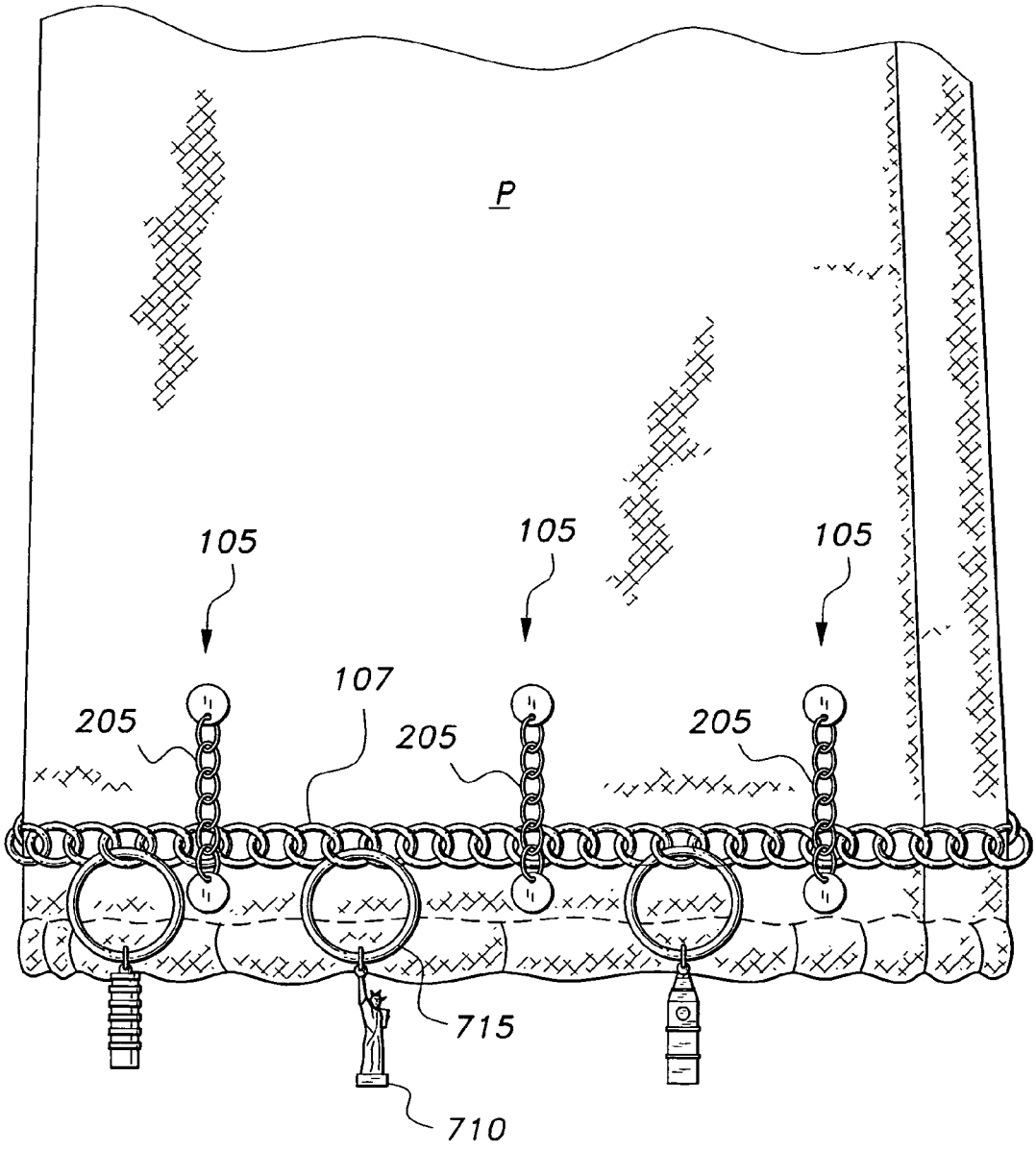
FIG. 7 is an environmental view of the clothing jewelry showing charms hung from leg loop chain embodiment, according to the present invention.

As shown in FIG. 7, the present invention 105 may comprise a plurality of trinkets 710 that can be directly attached to the chain loop 107 or, as in the embodiment shown, attached via joining ring 715.

Figure 8:
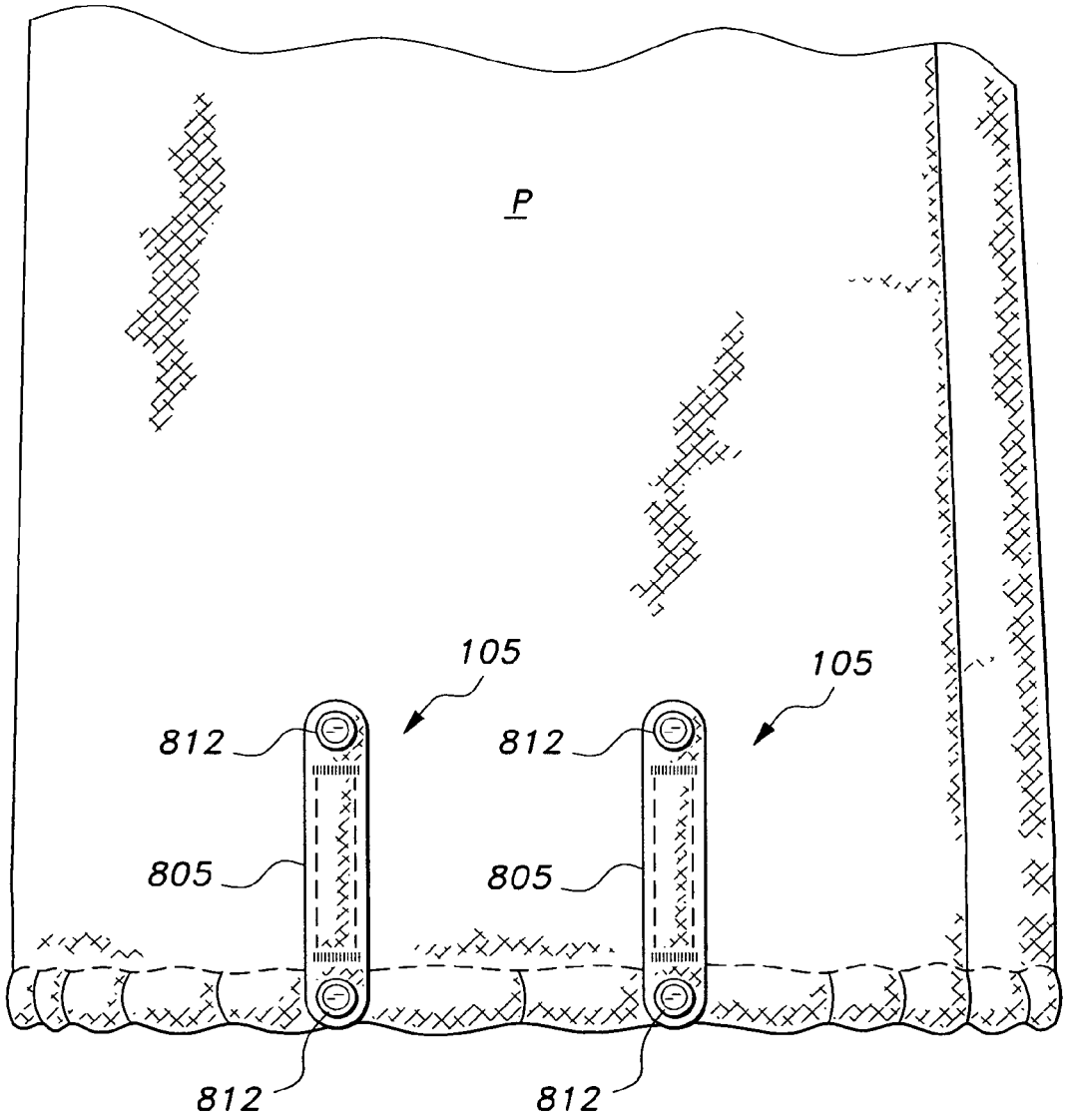
FIG. 8 is an environmental view of the clothing jewelry showing denim loops, according to the present invention.

As shown in FIG. 8, the present invention 105 may comprise a plurality of denim or other cloth-like material retainer loops 802 that can be held in place on an article of clothing such as pant leg P by a broad head 812 having a clutch back, such as the clutch back 215 shown in FIG. 2.

Figure 9:
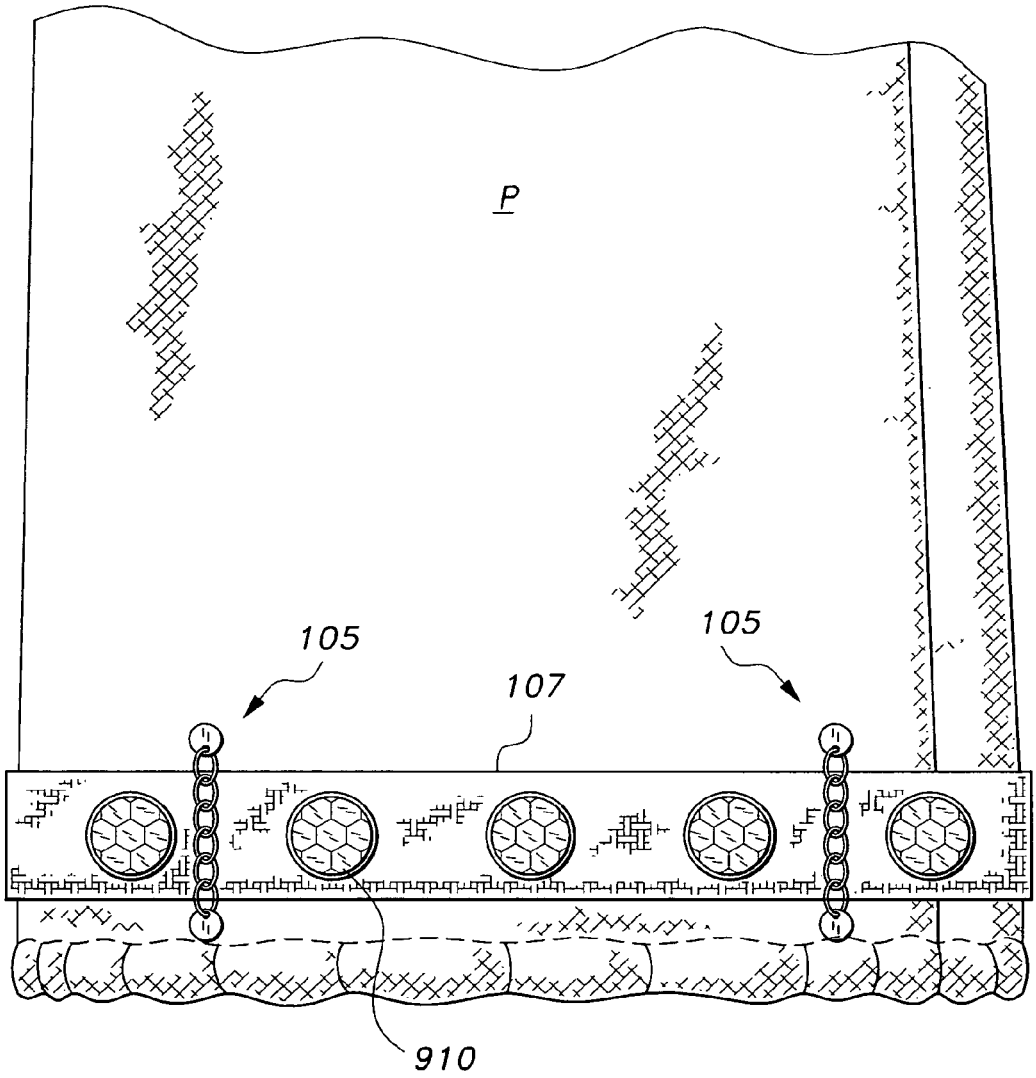
FIG. 9 is an environmental view of the clothing jewelry showing rhinestones attached to the leg loops, according to the present invention.

As shown in FIG. 9, the present invention 105 may comprise rhinestone or other similar adornments 910 applied to the decorative member 107.

It is to be understood that the present invention is not limited to the embodiment described above, but encompasses any and all embodiments within the scope of the following claims.

We claim:

1. Clothing jewelry, comprising:

a plurality of short chains, each of the chains having opposing ends;

a releasable fastener attached to each of the ends of each of the chains, whereby each of the ends of each of the plurality of short chains is adapted for removable attachment to an article of clothing to form a plurality of retainer loops;

an elongated decorative member inserted through the retainer loops and formed into an endless loop adapted to encircle an element of the article of clothing; and wherein the elongated decorative member has a fastener for releasably forming the endless loop.

2. The clothing jewelry according to claim 1, wherein the releasable fastener comprises a pin capable of penetrating the garment so that the pin can be removably attached to a clutch back behind the garment.

3. The clothing jewelry according to claim 2, wherein the pin has a broad head that may include a decorative element formed on the head.

4. The clothing jewelry according to claim 3, wherein the decorative element formed on the pin head is floral appearing.

5. The clothing jewelry according to claim 4, wherein the floral appearing decorative element looks like at least one rose.

6. The clothing jewelry according to claim 3, wherein the decorative element formed on the pin head is stone appearing.

7. The clothing jewelry according to claim 6, wherein the stone appearing decorative element appears to be a rhinestone.

8. The clothing jewelry according to claim 2, wherein the pin head includes an eccentric hole adapted to receive an end link in the chain.

9. The clothing jewelry according to claim 1, wherein the short chains may have any combination of fine and coarse links.

10. The clothing jewelry according to claim 1, wherein the short chains may have a ribbon threaded through links of the short chain.

11. The clothing jewelry according to claim 1, wherein the chain links and removable attachment adaptation devices may be made of a variety of materials including, but not limited to plastic, aluminum, copper, titanium, steel, and the like.

12. The clothing jewelry according to claim 1, wherein the elongated decorative member comprises a chain.

13. The clothing jewelry according to claim 12, wherein the chain comprises a ribbon threaded through links in the chain.

14. The clothing jewelry according to claim 1, wherein the endless loop decorative member has a plurality of charms attached to it.

15. The clothing jewelry according to claim 1, wherein the elongated decorative member is a ribbon of flexible material.

16. The clothing jewelry according to claim 15, wherein the flexible material comprises cloth.

17. The clothing jewelry according to claim 15, wherein a plurality of stone-like adornments may be attached to the decorative member.

* * * * *